US012408708B2

(12) United States Patent
Garcia Garcia

(10) Patent No.: US 12,408,708 B2
(45) Date of Patent: Sep. 9, 2025

(54) AEROSOL GENERATING DEVICE, METHOD AND CONTROL CIRCUITRY THEREFOR

(71) Applicant: JT International SA, Geneva (CH)

(72) Inventor: Eduardo Jose Garcia Garcia, Grand-Saconnex (CH)

(73) Assignee: JT International S.A. (CH)

( * ) Notice: Subject to any disclaimer, the term of this patent is extended or adjusted under 35 U.S.C. 154(b) by 481 days.

(21) Appl. No.: 17/909,616

(22) PCT Filed: Mar. 5, 2021

(86) PCT No.: PCT/EP2021/055669

§ 371 (c)(1),
(2) Date: Sep. 6, 2022

(87) PCT Pub. No.: WO2021/180599

PCT Pub. Date: Sep. 16, 2021

(65) Prior Publication Data

US 2023/0122097 A1 Apr. 20, 2023

(30) Foreign Application Priority Data

Mar. 11, 2020 (EP) ..... 20162551

(51) Int. Cl.
*A24F 40/57* (2020.01)
*A24F 40/20* (2020.01)
(Continued)

(52) U.S. Cl.
CPC ..... *A24F 40/57* (2020.01); *A24F 40/46* (2020.01); *A24F 40/51* (2020.01); *A24F 40/53* (2020.01); *A24F 40/60* (2020.01); *A24F 40/20* (2020.01)

(58) Field of Classification Search
None
See application file for complete search history.

(56) References Cited

U.S. PATENT DOCUMENTS

2016/0206005 A1 7/2016 Yamada et al.
2018/0020735 A1 1/2018 Bilat et al.
(Continued)

FOREIGN PATENT DOCUMENTS

EP 3042576 A1 7/2016
KR 20180085365 A * 7/2018
(Continued)

OTHER PUBLICATIONS

KR_20180085365 English Translation obtained from Espacenet, pp. 1-18 (Year: 2018).*
(Continued)

*Primary Examiner* — Philip Y Louie
*Assistant Examiner* — Madeleine P Delacruz
(74) *Attorney, Agent, or Firm* — Lerner David LLP

(57) ABSTRACT

A method for controlling an aerosol generating device includes receiving an indication to start an aerosol generating session via a user input element; receiving a temperature of a heater measured by a temperature sensor; retrieving a session counter value from a memory; controlling the heater to perform an aerosol generating session according to the temperature of the heater and the session counter value; and when the temperature of the heater becomes lower than a first predetermined temperature, resetting the session counter value. Control circuitry configured to perform the method and an aerosol generating device including the control circuitry are also provided.

14 Claims, 9 Drawing Sheets

(51) Int. Cl.

| | |
|---|---|
| ***A24F 40/46*** | (2020.01) |
| ***A24F 40/51*** | (2020.01) |
| ***A24F 40/53*** | (2020.01) |
| ***A24F 40/60*** | (2020.01) |

(56) References Cited

U.S. PATENT DOCUMENTS

| | | | | |
|---|---|---|---|---|
| 2019/0216136 | A1 | 7/2019 | Capuano | |
| 2019/0387796 | A1* | 12/2019 | Cohen | A24F 40/65 |
| 2020/0352248 | A1 | 11/2020 | Yamada et al. | |
| 2023/0109861 | A1* | 4/2023 | Cho | A24F 40/10 131/329 |

FOREIGN PATENT DOCUMENTS

| | | | | |
|---|---|---|---|---|
| WO | 2019129845 | A1 | 7/2019 | |
| WO | 2019141577 | A1 | 7/2019 | |
| WO | 2019146062 | A1 | 8/2019 | |
| WO | 2019186158 | A1 | 10/2019 | |
| WO | WO-2019196514 | A1 * | 10/2019 | A24F 40/57 |
| WO | 2020007726 | A1 | 1/2020 | |
| WO | 2020008008 | A1 | 1/2020 | |

OTHER PUBLICATIONS

WO-2019196514-A1 English Translation obtained from Esapcenet, pp. 1-15 (Year: 2019).*

WO-2019146062-A1 English Translation obtained from Esapcenet, pp. 1-34 (Year: 2019).*

International Search Report for PCT/EP2021/055669 mailed Jun. 28, 2021. 5 pgs.

Search Report dated Feb. 16, 2025 from the Office Action for Chinese Application No. 202180020152.6 issued Feb. 22, 2025. 2 pages.

* cited by examiner

AEROSOL GENERATING DEVICE, METHOD AND CONTROL CIRCUITRY THEREFOR

CROSS-REFERENCE TO RELATED APPLICATIONS

The present application is a national phase entry under 35 U.S.C. § 371 of International Application No. PCT/EP2021/055669, filed Mar. 5, 2021, published in English, which claims priority to European Application No. 20162551.4 filed Mar. 11, 2020, the disclosures of which are incorporated herein by reference.

TECHNICAL FIELD

The present disclosure relates to an aerosol generation device in which an aerosol generating substrate is heated to form an aerosol. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 350° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aerosolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

Aerosol generation devices are often hand-held. However, the operating temperature for aerosol generation is too high for direct contact with a user of the device. Accordingly, it is desirable to provide a safe device which does not reach a temperature that affects user comfort or safety.

SUMMARY

According to a first aspect, the present disclosure provides a method for controlling an aerosol generating device, the method comprising: receiving an indication to start an aerosol generating session via a user input element; receiving a temperature of a heater measured by a temperature sensor; retrieving a session counter value from a memory; controlling the heater to perform an aerosol generating session according to the temperature of the heater and the session counter value; and when the temperature of the heater becomes lower than a first predetermined temperature, resetting the session counter value.

The session counter value is a counter indicative of a number of aerosol generation sessions which have been performed with the device remaining in a relatively hot state, i.e. without the device reaching a thermal equilibrium state after a session.

Some heat will inevitably leak from the heater into the rest of the aerosol generating device. By controlling the heater according to the temperature of the heater and a session counter, a build-up of heat in the rest of the aerosol generating device can be estimated, and consequently a temperature of the rest of the aerosol generating device can be estimated.

By setting a session limit, the temperature of the rest of the aerosol generating device is also limited. The session limit may, for example, be set by experimentally determining how many consecutive sessions may be performed.

Optionally, the session counter value is incremented upon starting the aerosol generating session.

Incrementing the session counter value upon starting the aerosol generating session improves the safety of the device, by comparison to counting completed aerosol generating sessions. For example, an aerosol generating session may not be completed in a case that a user presses a button to shut down the device or removes a consumable from the device. However, this may occur after a substantial amount of heat has been delivered in the aerosol generating session. By counting the session upon starting, the session counter value is biased towards indicating an overestimate of the temperature in the aerosol generating device, which further decreases the chance of the aerosol generating device becoming excessively hot for a user.

Resetting the session counter value based on the temperature of the heater further improves safety, because the rate of cooling of the device will be dependent upon external factors such as ambient temperature, and therefore direct verification of cooling is the most predictable way of ensuring that it is safe to continue using the device.

Optionally, the method comprises, when the temperature of the heater becomes lower than a second predetermined temperature higher than the first predetermined temperature, and the session counter value is lower than a first predetermined session limit, resetting the session counter value.

Providing a first absolute threshold and a second higher conditional temperature threshold for resetting the session counter value provides a compromise between safety and user convenience, by enabling the user to perform more consecutive aerosol generating sessions if they allow some time for cooling between sessions.

Optionally, the aerosol generating session comprises: a temperature raising stage in which the temperature of the heater is raised to at least a third predetermined temperature; a temperature maintaining stage in which the temperature of the heater is maintained; and a temperature falling stage in which the temperature of the heater is allowed to fall below the third predetermined temperature.

By maintaining a temperature of the heater for a stage of an aerosol generating session, an aerosol can be generated effectively and efficiently.

Optionally, the method further comprises: if the session counter value is not lower than a second predetermined session limit, controlling the heater not to perform an aerosol generating session.

Inhibiting aerosol generating sessions when a session limit is reached has the effect of reducing the risk that the aerosol generating device reaches an excessively high temperature.

Optionally, the method further comprises: if the temperature of the heater is greater than a fourth predetermined temperature when the indication to start an aerosol generating session is received, controlling the heater not to perform an aerosol generating session regardless of the session counter value.

By setting a heater temperature above which an aerosol generating session does not start, a minimum level of cooling between sessions can be enforced, thereby increasing the number of closely consecutive sessions which can be performed while maintaining user safety and comfort.

Optionally, if the temperature of the heater is lower than a fifth predetermined temperature when the indication to start an aerosol generating session is received, the session counter value is not incremented.

By setting a heater temperature below which sessions are not regarded as consecutive, the device is prevented from unnecessarily restricting aerosol generating sessions when the device is adequately able to cool between sessions.

Optionally, the method comprises: controlling the heater not to perform an aerosol generating session after receiving an indication to start an aerosol generating session, and controlling a user output element to indicate a status wherein the indication was received but the aerosol generating session is not being performed.

Providing a status indication when inhibiting an aerosol generating session allows the user to understand that the device is functioning normally, and ensures that the above-described safety features do not make the device harder to use.

Optionally, the method comprises: controlling the heater not to perform an aerosol generating session after receiving an indication to start an aerosol generating session, and waiting until the temperature of the heater falls below a sixth predetermined temperature, and then performing an aerosol generating session.

By delaying the aerosol generating session until the heater temperature has fallen, safety and comfort is ensured whilst also allowing aerosol generating sessions at an increased safe frequency Optionally, the heater comprises a heating element and the temperature sensor is arranged to measure a temperature of the heating element.

Optionally, the heating element comprises a flexible sheet with a resistive track and the temperature sensor mounted thereon.

Optionally, the heater comprises a heating chamber for receiving the consumable and an insulator surrounding the heating chamber, and the temperature sensor is arranged between the heating chamber and the consumable.

Optionally, the heater comprises a pot-shaped heating chamber having an open end for receiving the consumable, and comprises a heating element arranged to supply heat to the heating chamber through a side wall of the heating chamber.

According to a second aspect, the present disclosure provides control circuitry configured to perform a method as described above.

Optionally, where the control circuitry is for an aerosol generating device additionally comprising a second temperature sensor for measuring a temperature of the control circuitry, the method further comprises: if the temperature of the control circuitry is greater than a seventh predetermined temperature when the indication to start an aerosol generating session is received, controlling the heater not to perform an aerosol generating session regardless of the session counter value.

By specifically measuring a temperature of the control circuitry before performing an aerosol generating session, and setting a threshold above which an aerosol generating session will not be performed, safety can be improved by reducing the chance that the control circuitry leaves its normal operating temperature range.

According to a third aspect, the present disclosure provides an aerosol generating device comprising: control circuitry as described above, the heater for heating an aerosol generating substrate of a consumable to generate an aerosol, the temperature sensor for measuring a temperature of the heater, the user input element for starting an aerosol generating session, and the memory for storing a session counter value.

DETAILED DESCRIPTION

Figure 1:
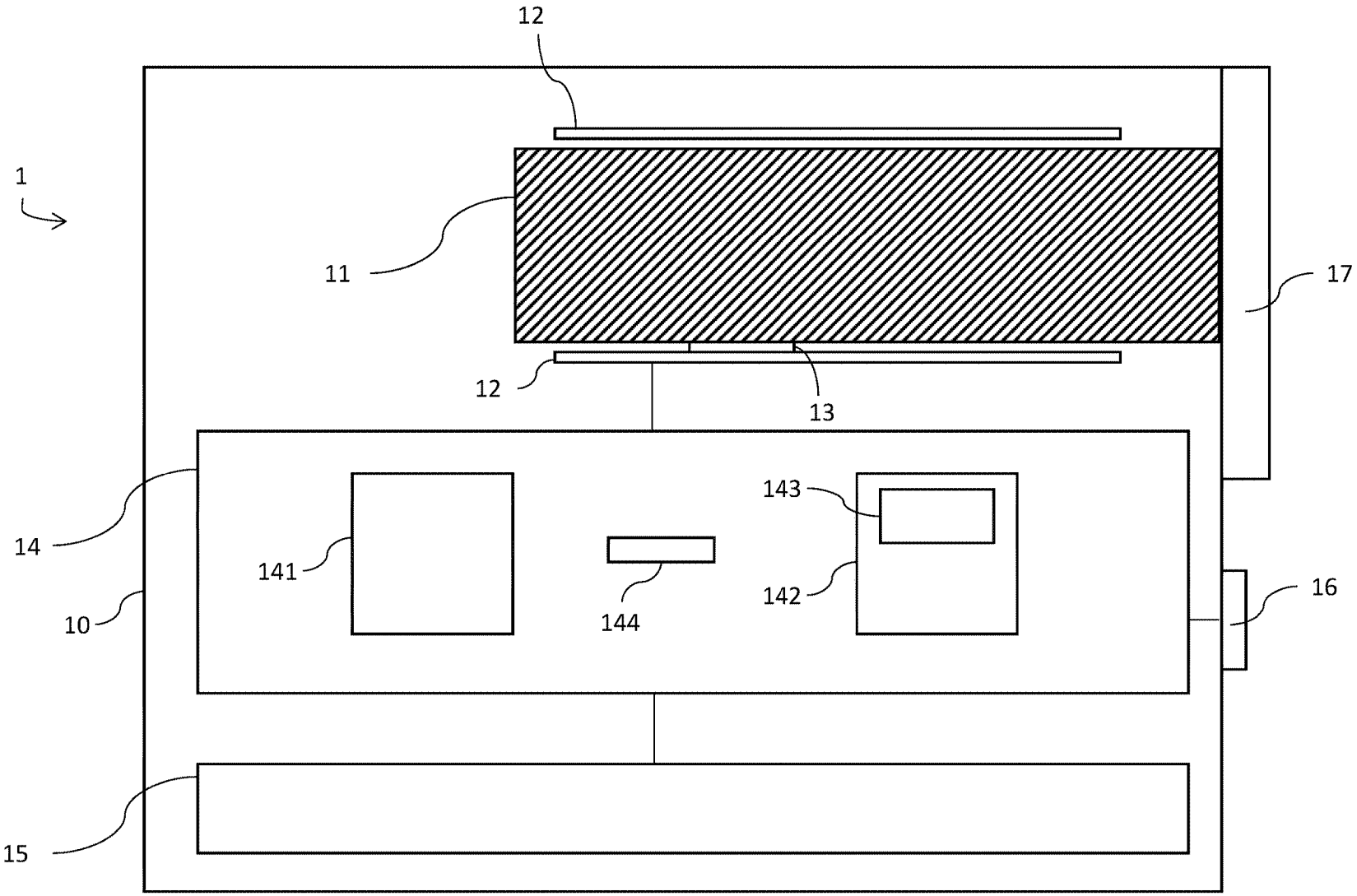
FIG. 1 is a schematic illustration of an aerosol generating device.

FIG. 1 is a schematic illustration of an aerosol generating device 1 comprising a heating chamber 11, a heating element 12, control circuitry 14, a power supply 15, a temperature sensor 13, a user input element 16 and a lid 17.

In use, an aerosol generating substrate is received in the heating chamber 11 and the heating element 12 supplies heat into the heating chamber 11 to heat the substrate and generate an aerosol. Additionally, a temperature sensor 13 is arranged in or near to the heating chamber 11. The heating chamber 11, the heating element 12 and the temperature sensor 13 may together be referred to as a heater.

The heating chamber 11 is a structure having an internal hollow and adapted to receive the aerosol generating substrate. The heating chamber 11 may, for example, be formed from ceramic or metal. For example, the heating chamber 11 may be formed by bending or stamping sheet metal. In one example, the heating chamber 11 may be a tubular structure comprising a side wall extending between a first end and a second end. The first end is open, or openable in use, in order to allow the substrate to be added or removed. The second end may be open, in order to provide an air inlet for air to flow through the consumable. Alternatively, the second end may be closed in order to reduce heat leakage.

The heater 12 may be any heater suitable to deliver heat into the heating chamber 11. For example, the heater 12 may be a planar heater attached to a flexible support and wrapped around a side wall of the heating chamber 11. Such a planar heater may be in the form of a resistive track driven by electricity, and the support may be one or more plastic or polymer sheets, for example a polyimide, a fluoropolymer such as PTFE, or a polyetheretherketone (PEEK). Alternatively, other types of heater such may be used in which heat is provided by a chemical reaction such as fuel combustion. Alternatively the heating element 12 may be located inside the heating chamber 11 or on a surface of the heating chamber 11. The heating element 12 may also be integrally formed with the heating chamber 11.

The heating element 12 is typically surrounded by insulation such that heat is more efficiently delivered into the heating chamber 11 rather than heating up the rest of the device 1. However, in general, at least some heat will dissipate into the rest of the aerosol generating device.

The heating element 12 and the temperature sensor 13 are operated by control circuitry 14 which includes a logic circuit 141 (e.g. a general-purpose processor, or an ASIC) and a memory 142 storing at least a session counter value 143. The logic circuit 141 may be configured to execute a series of instructions stored in the memory 142, for example using a general-purpose processor, and/or may be "hard coded" with logic for controlling the heating element 12 based on the session counter value 143 and input from the temperature sensor 13.

Optionally, the control circuitry 14 may comprise a second temperature sensor 144 for measuring its own temperature.

The power supply 15 may be an electrical power supply, such as a battery. The power supply may be rechargeable, for example via an external power connector on an outer surface of the device 1. The control circuitry 14 is configured to control supply of power from the power supply 15 to the heating element 12. The control circuitry 14 may additionally be configured to regulate charging of the power supply 15.

As an alternative, the heating element 12 may be powered by a non-electrical power supply, such as a fuel which is combusted in the heating element 12. In such embodiments, the control circuitry 14 may be configured to control supply of the fuel as a way of controlling power supply to the heating element 12.

The control circuitry 14 is also configured to receive an input from the user input element 16. The user input element 16 may be any type of input element such as, for example, be a button, a slider or a capacitive sensor, or a slider. The user input element 16 is operated by a user of the device 1 in order to indicate that an aerosol generating substrate is ready in the heating chamber 11 and the user wishes to start an aerosol generating session.

The user input element 16 could instead be integrated in the heater. More specifically, the user input element 16 could be a detecting means for detecting the presence of an aerosol generating substrate in the heating chamber 11, such as a light gate for detecting a consumable comprising the aerosol generating substrate. In this way, an aerosol generating session could be automatically started upon provision of the aerosol generating substrate.

The device 1 may also comprise additional user input elements for other purposes such as configuring a strength of generated aerosol, and may comprise input elements which are not operated directly by a user, such as a sensor for detecting an open/closed state of the lid 17.

The lid 17 is a preferable, but optional, feature. In this embodiment, the lid 17 is arranged to keep the heating chamber 11 closed and protected when not in use. The lid 17 may, for example, be a sliding lid constrained by a rail to move between closed and open positions.

The components of the aerosol generating device 1 are contained within a housing 10. The housing 10 may, for example, comprise a polymer such as polyetheretherketone (PEEK) or polyamide (PA), and/or a metal frame comprising, for example, aluminium. As an aerosol generating session is performed, some heat leaks from the heater into the housing. The extent to which the housing 10 heats up over consecutive aerosol generating sessions depends on the balance between heat leaking from the heater and heat dissipating from the exterior of the device 1.

Figure 2:
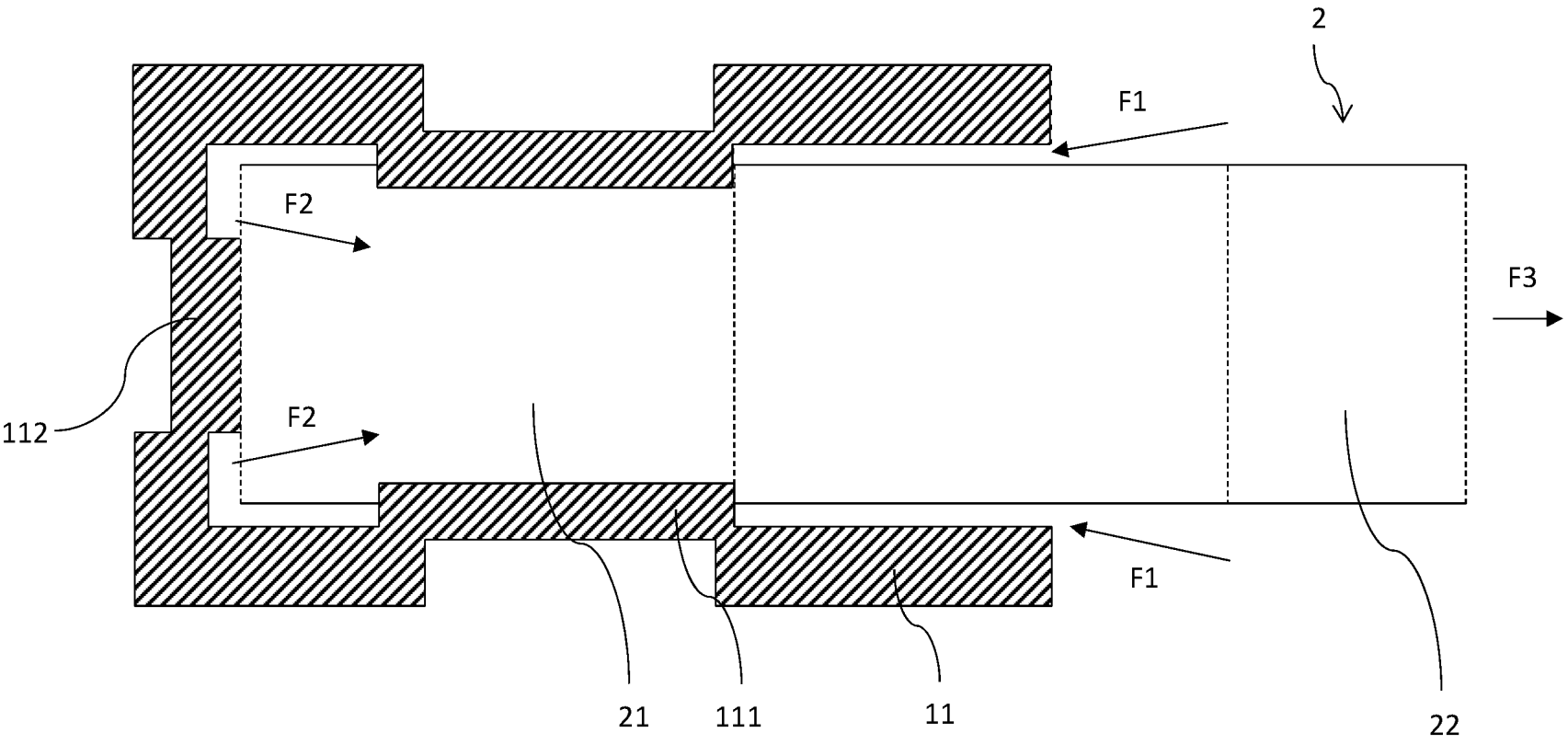
FIG. 2 is a schematic illustration of a heater of the aerosol generating device.

FIG. 2 is a schematic illustration showing additional detail of a heater in an embodiment of the aerosol generating device 1, and its usage for heating a consumable 2 comprising aerosol generating substrate 21.

More specifically, the consumable 2 in this embodiment is a tubular structure comprising a section 21 at one end along its length in which an aerosol generating substrate is contained. The section 21 is inserted into the heating chamber 11 of the heater, in order to generate an aerosol. Meanwhile a mouth end 22, which may comprise a filter, extends out of the heating chamber 11 to provide a mouthpiece.

In this example, the heating chamber 11 is a tubular structure which includes ribs 111 along a side wall for maintaining space between the consumable 2 and the side wall, and includes a platform 112 for maintaining space between the consumable 2 and an end wall of the heating chamber 11. In use, the user inhales aerosol from the consumable 2 via the mouth end 22. Air flows via arrows F1 into the heating chamber 11 between the consumable 2 and the side wall of the chamber 11, into the consumable 2 at arrows F2, and out at arrow F3.

This is just one example configuration of the heating chamber 11 and the aerosol generating substrate 21. In other alternative examples, air may be caused to flow through a loose aerosol generating substrate in the heating chamber 11. A mouthpiece may form part of the aerosol generating device 1 rather than part of a consumable 2. The heating chamber 11 may comprise an air inlet separate from an air outlet.

The particular configuration of the heater and the aerosol generating substrate is not constrained herein. Rather the present invention is concerned with measures to improve safety of the device 1 using a particular method for controlling the heater.

Aerosol generation is typically performed in sessions. Where consumables 2 are used, a "session" may be a period in which a consumable is fully used. Alternatively, a "session" may be a period in which a predetermined amount (be it precise or approximate) of aerosol is generated by the aerosol generating device 1.

Figure 3:
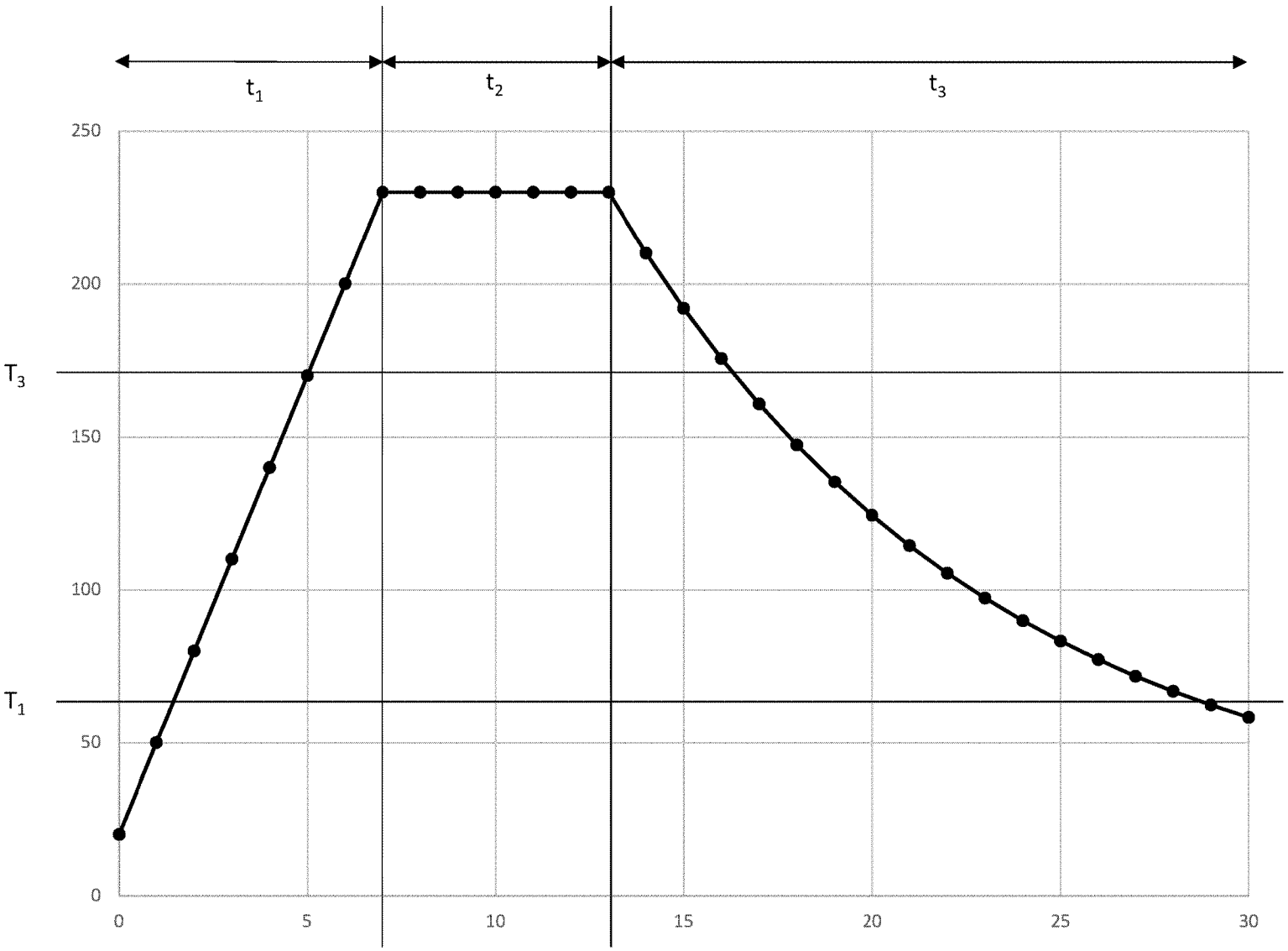
FIG. 3 is a flowchart schematically illustrating a method for controlling the aerosol generating device.

FIG. 3 is a graph schematically illustrating an example aerosol generating session in the aerosol generating device, where temperature of the heater is shown on the y-axis and time is shown on the x-axis.

In this example, the aerosol generating session comprises a temperature rising stage $t_1$ in which the temperature of the heater is raised to at least an aerosol generation temperature $T_3$. A time length of the temperature rising stage $t_1$ may be predetermined. In another example, the temperature rising stage $t_1$ may continue until feedback from the temperature sensor 13 indicates that the aerosol generation temperature $T_3$ has been reached. The aerosol generation temperature $T_3$ is chosen based on the type of aerosol generating substrate, and is a temperature at which aerosol is generated by heating the aerosol generating substrate. As shown in FIG. 3, the temperature of the heater is raised some way above the aerosol generation temperature $T_3$ and the aerosol generation temperature is a lower limit for aerosol generation. In an example where the aerosol generating substrate comprises tobacco and an aerosol former such as glycerine, it has been found that 170° C. is suitable as a value for $T_3$, and aerosol generation is improved by continuing to heat the aerosol generating substrate to 230° C.

Then, a temperature maintaining stage $t_2$ occurs in which the temperature of the heater is maintained. Although the temperature is illustrated as flat, it is likely to vary around a desired temperature. For example, the temperature may be maintained using pulse width modulation (PWM) control of the heater. During this time, aerosol may be extracted from the aerosol generating substrate in one or more puffs. In the example where the aerosol generating substrate comprises tobacco and an aerosol former, it has been found that 4 minutes and 10 seconds is a suitable example length for $t_2$.

Finally, a temperature falling stage $t_3$ occurs in which the temperature of the heater is allowed to fall below the aerosol generation temperature $T_3$. In general the heater is not powered during the temperature falling stage, although controlling a rate of cooling may have advantages, for example with respect to cleaning out the heating chamber after use. A time length of the temperature falling stage $t_3$ is not generally constrained, and the temperature falling stage may in some cases be interrupted by the start of a next aerosol generating session. However, a minimum time length $t_3$ may be set in some embodiments, the minimum time length being for example 20 seconds.

FIG. 3 also illustrates a "cool" temperature $T_1$ at which the aerosol generating device 1 is regarded as sufficiently cool that it is not necessary to track cumulative heating of the device over multiple sessions, as will be explained further below. In a specific example, it has been found that 65° C. is a suitable temperature $T_1$.

Figure 4:
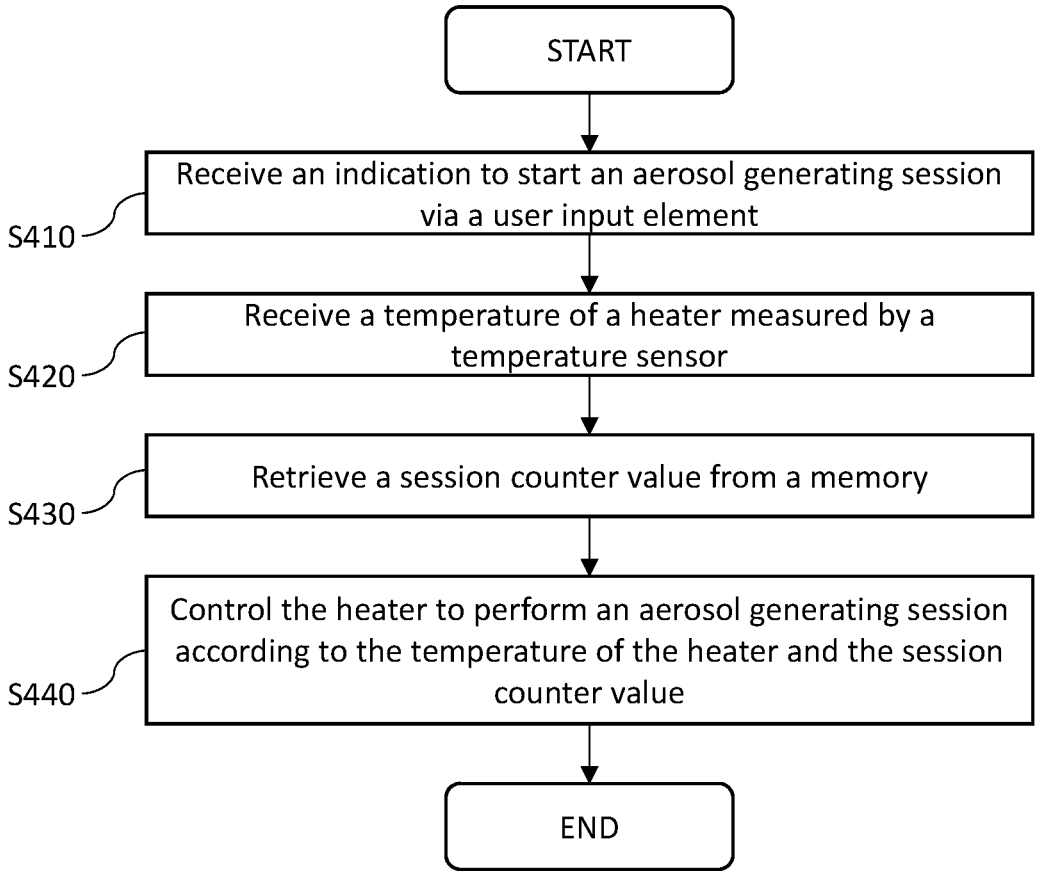
FIG. 4 is a graph schematically illustrating an aerosol generating session in the aerosol generating device, where temperature of a heater is shown on the y-axis and time is shown on the x-axis.

FIG. 4 is a flowchart schematically illustrating a method for controlling the aerosol generating device.

At step S410, the control circuitry 14 receives an indication to start an aerosol generating session via the user input element 16.

At step S420, the control circuitry 14 receives a temperature of a heater measured by a temperature sensor. This measurement may be indirect. For example, in the case that the temperature sensor 13 is a thermistor, the control circuitry 14 uses an electrical connection across the temperature sensor 13 to measure a resistance, and then uses a known relationship between resistance and temperature (e.g. a look-up table or a continuous function) to identify the temperature.

At step S430, the control circuitry 14 retrieves the session counter value 143 from memory 142. The session counter value is a counter indicative of a number of aerosol generation sessions which have been performed with the device remaining in a relatively hot state, i.e. without the device reaching a thermal equilibrium state after a session. A relatively hot state may be defined differently in different embodiments. For example, a "relatively hot state" may be any temperature above the cool temperature $T_1$. Additionally, the meaning of "relatively hot state" may be dependent upon the session counter value as described further below. The session counter value 143 is stored to persist between aerosol generating sessions. When the control circuitry 14 is first activated the session counter value 143 may be initialised with a default value, sensibly zero. As described further below, the session counter value may be incremented in response to aerosol generating sessions and may be reset to its default value under certain conditions.

At step S440, the control circuitry 14 controls the heater to perform an aerosol generating session according to the temperature of the heater and the session counter value obtained in steps S420 and S430. More specifically, the control circuitry 14 decides whether or not to perform an aerosol generating session in accordance with the user's request of step S410 and, if an aerosol generating session is performed, controls the heating element 12 in the aerosol generating session. For example, the aerosol generating session may be a session as described above with reference to FIG. 3.

Figure 5:
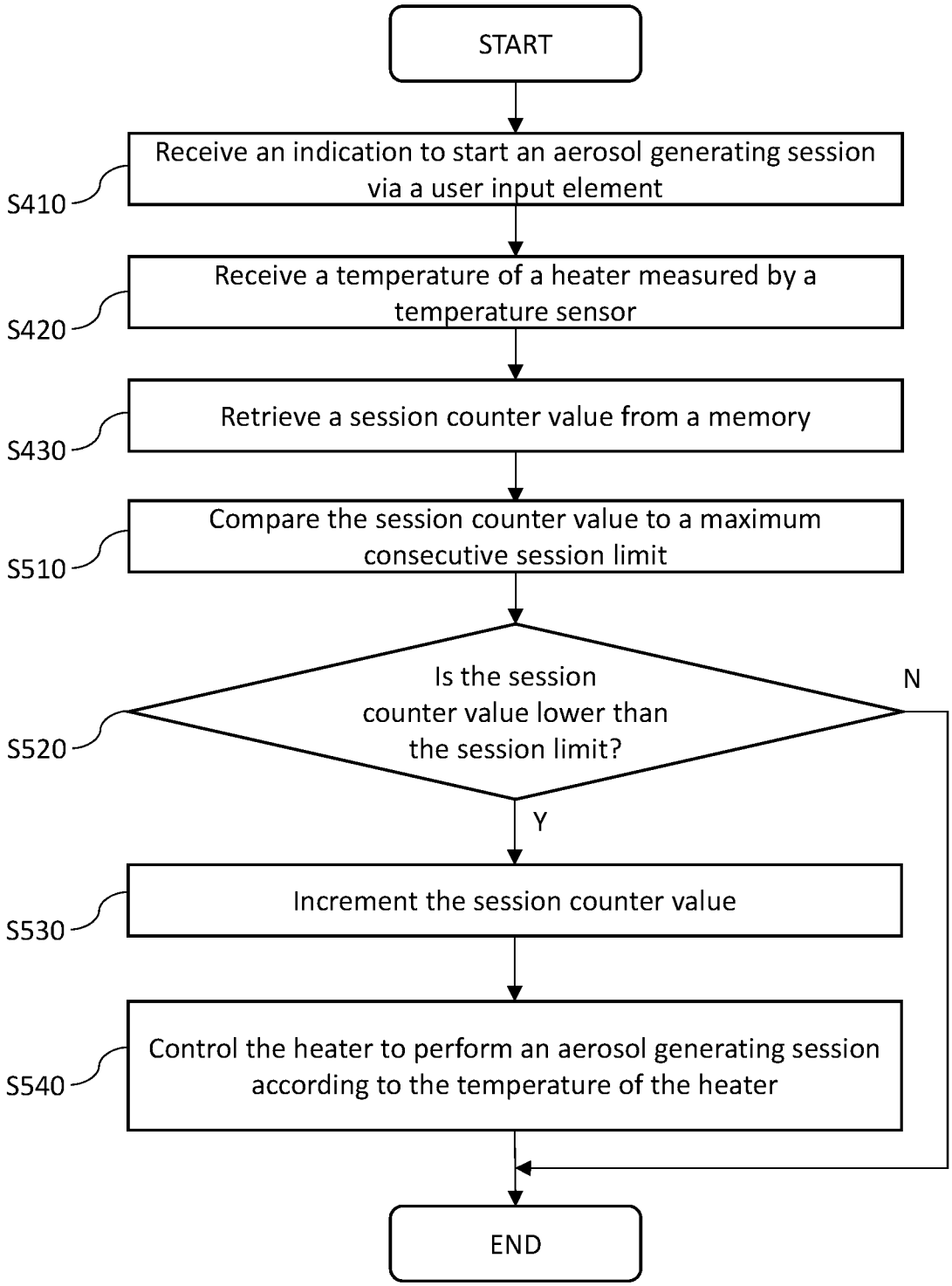
FIG. 5 is a flowchart schematically illustrating additional detail of a method for controlling the aerosol generating device.

FIG. 5 is a flowchart schematically illustrating additional detail of a specific method for controlling the aerosol generating device.

In the embodiment of FIG. 5, step S440 is specified in more detail as steps S510-S540.

In steps S510 and S520, the control circuitry 14 compares the session counter value 143 retrieved in step S430 to a maximum consecutive session limit $S_{max}$, and decides to perform an aerosol generating session if the session counter value 143 is lower than the session limit $S_{max}$. In an embodiment, it has been found that $S_{max}$ is suitably 3 (three), although this depends on the particular configuration of the device 1 and specifically depends upon how much heat leaks from the heater into the rest of the device during an aerosol generating session.

At step S530, the control circuitry 14 increments the session counter value 143. Usually this means increasing the value by one, although any counting unit may be used. In a preferred embodiment, a minimum start temperature $T_2$ is defined for counting sessions, under which session are not regarded as continuous and are not counted. In a specific example, the minimum start temperature $T_2$ may preferably be a temperature in the range of 100° C. to 120° C., and most preferably 100° C.

At step S540, the control circuitry 14 controls the heater to perform an aerosol generating session according to the temperature of the heater. This may be an aerosol generating session as described for FIG. 3.

In the example of FIG. 5, the session counter value 143 is incremented at step S530 before the aerosol generating session is performed at step S540. However, the session counter value 143 may be incremented at other times to record the aerosol generating session. For example, referring to the example session of FIG. 3, the session counter value 143 may instead be incremented after the temperature raising stage $t_1$, or after the temperature maintaining stage $t_2$, or after a predetermined time has elapsed from the start of the aerosol generating session.

On the other hand, at step S520, if the session counter value 143 is not lower than the session limit $S_{max}$, then the control circuitry 14 controls the heater not to perform an aerosol generating session (i.e. the control circuitry 14 does not activate the heater).

Optionally, when the control circuitry 14 decides not to perform an aerosol generating session, the device 1 indicates a status wherein it is acknowledged that the user input was received in step S410 but the aerosol generating session is not being performed. As examples, this status indication may take the form of a static light indicator, a flashing light indicator, an animated combination of several light indicators, a vibration output or a sound output.

Alternatively, when the control circuitry 14 decides not to perform an aerosol generating session, the control circuitry 14 may wait for a suitable condition for performing the aerosol generating session after a delay. For example, instead of proceeding from step S520 to the end of the method of FIG. 5, the control circuitry 14 may alternatively wait until the temperature of the heater falls below a continuation temperature threshold, and then perform the aerosol generating session. The continuation temperature threshold is preferably equal to the "cool" temperature $T_1$ described for FIG. 3, although the continuation temperature threshold may be separately configured. This alternative has the advantage that the device 1 can automatically perform the aerosol generating session as soon as it is ready, but the disadvantage that the user may not expect this. Preferably, if the device 1 is going to provide a delayed aerosol generating session, this is indicated as part of the above-described status indication.

Figure 6:
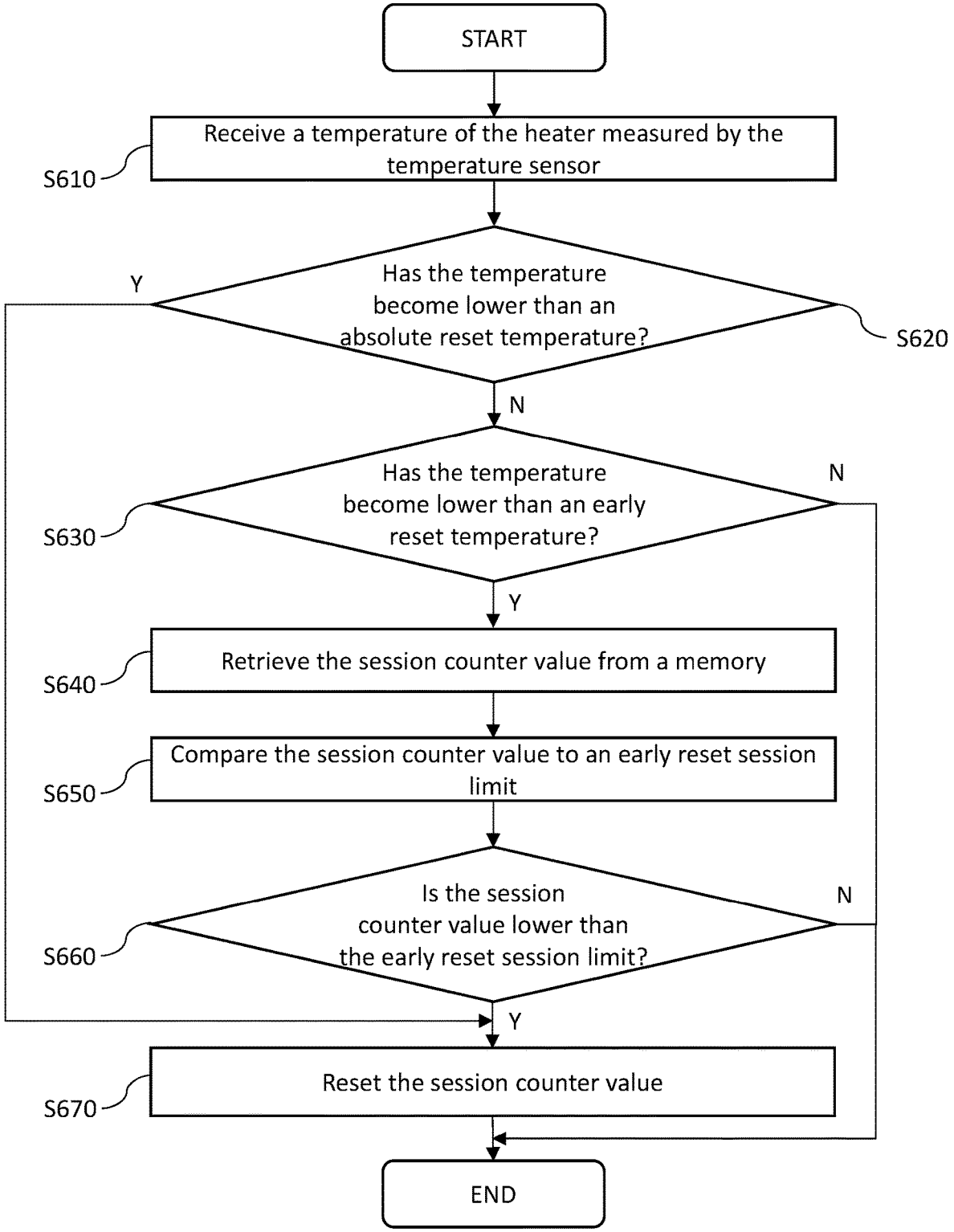
FIG. 6 is a flowchart schematically illustrating additional detail of a method for controlling the aerosol generating device.

FIG. 6 is a flowchart schematically illustrating additional detail of a method for controlling the aerosol generating device.

Specifically, FIG. 6 illustrates a control flow for resetting the session counter value 143.

At step S610, the control circuitry 14 receives a temperature of the heater measured by the temperature sensor.

At step S620, the control circuitry 14 determines if the received temperature indicates that the temperature of the heater has become lower than an absolute reset temperature and, if so, skips to step S670 where the session counter value 143 is reset to its initial value, usually zero.

The absolute reset temperature may be the previously-described "cool" temperature $T_1$, 65° C. in an example. For example, the control circuitry 14 may store a previous temperature measurement in memory 142 and, if the previous temperature measurement is above the absolute reset temperature $T_1$ and the temperature received in step S610 is below the absolute reset temperature $T_1$, then the temperature has become (transitioned to) below the absolute reset temperature. By detecting a temperature transition, rather than a single temperature measurement, the reset does not occur repeatedly while the device 1 is unheated. Alternatively, the steps of FIG. 6 could be disabled when the session counter value 143 is at its initial value, in which case the single temperature measurement received in step S610 can be used.

If the temperature of the heater has not become lower than the absolute reset temperature, then the flow proceeds to step S630. At step S630, the control circuitry 14 determines if the received temperature indicates that the temperature of the heater has become lower than an early reset temperature $T_2$ and, if not, the process ends.

The early reset temperature is a temperature which, although higher than the absolute reset temperature, indicates that significant cooling has taken place since the last aerosol generating session. The early reset temperature is preferably equal to the minimum start temperature $T_2$ described above at step S530 of FIG. 5. More specifically, in the particular example embodiment previously mentioned, a temperature in the range 100° C. to 120° C., most preferably 100° C., was found to be a suitable example value for the early reset temperature.

Otherwise, the flow proceeds to step S640. At step S640, the session counter value 143 is retrieved from the memory 142 similarly to step S430.

At steps S650 and S660, the session counter value 143 is compared to an early reset session limit. The early reset session limit may, for example, be equal to the maximum consecutive session limit $S_{max}$ of FIG. 5 step S510. Thus, if the session counter value 143 is lower than the early reset session limit, this indicates that the device 1 has not yet reached a maximum safe temperature due to heat leaking from the heater under continuous usage. In the specific example, the early reset session limit may be 3 (three) sessions.

If the session counter value 143 is lower than the early reset session limit, then the session counter value 143 is reset at step S670. Otherwise, the process of FIG. 6 ends.

The control circuitry 14 may perform the steps of FIG. 6 in parallel with the method of FIG. 4 or FIG. 5. For example, the flow of FIG. 6 may be triggered by an interrupt input of the logic circuit 141 that is connected to a hardwired temperature comparison unit.

Alternatively, the steps of FIG. 4 or 5 and the steps of FIG. 6 may be performed alternately in one continuous control loop that controls both responding to user indications to start an aerosol generating session and resetting of the session counter value.

In some embodiments, the early reset temperature, and its associated logic at steps S630 to S660, may be omitted, in which case the process ends following a negative outcome at step S620.

Furthermore, in some embodiments, the process for resetting the session counter value 143 may be entirely omitted and, for example, a user may be required to turn the device off in order to reset the session counter value 143. This can be implemented by storing the session counter value 143 in volatile memory.

Figure 7:
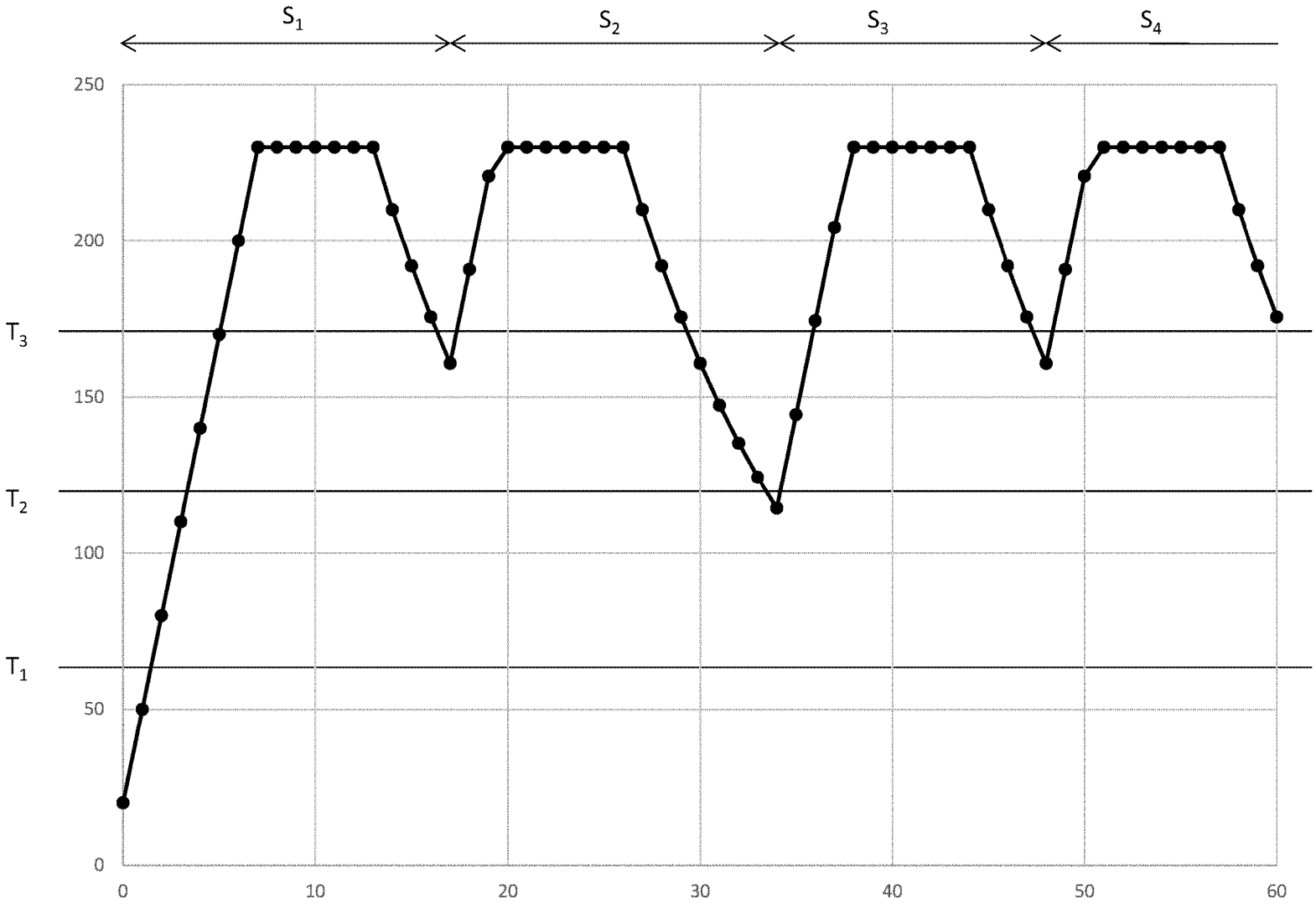
FIG. 7 is a graph schematically illustrating consecutive aerosol generating sessions in the aerosol generating device, where temperature of a heater is shown on the y-axis and time is shown on the x-axis.

FIG. 7 is a graph schematically illustrating consecutive aerosol generating sessions in the aerosol generating device, where temperature of a heater is shown on the y-axis and time is shown on the x-axis.

FIG. 7 shows four aerosol generating sessions $S_1$ to $S_4$.

At the start of session $S_1$, the session counter value 143 is at its initial value (zero). The device 1 starts at below the minimum start temperature T2 described above, and therefore the session counter value 143 is not incremented at step S530 for session $S_1$. At step S540 of FIG. 5, the stages $t_2$, $t_3$ of FIG. 3 occur.

However, before the device 1 can fully cool down in stage $t_3$ of session $S_1$, the control circuitry 14 receives a further indication to start an aerosol generating session (step S410), and begins session $S_2$. This time the temperature of the heater at the start of the session is greater than the minimum start temperature $T_2$, and the session counter value 143 is incremented at step S530 (from zero to one). Then, at step S540, stages $t_1$, $t_2$ and $t_3$ of FIG. 3 are performed. This time, in stage $t_3$ of session $S_2$, the temperature of the heater becomes lower than the early reset temperature $T_2$ of FIG. 6 step S630. The control circuitry 14 evaluates the condition of step S660, determines that the session counter value 143 (one) is lower than the early reset session limit (three), and resets the session counter value at step S670.

The user then gives further indications (step S410) to perform further sessions $S_3$ and $S_4$, as shown in FIG. 7. However, because the session counter value 143 has reset and session $S_3$ starts below the minimum start temperature $T_2$, the session counter value records a value of only one at the end of step $S_4$. Hence, it can be seen how the control flow extends the number of allowed consecutive sessions in the case of the user allowing the device to partly cool.

Figure 8:
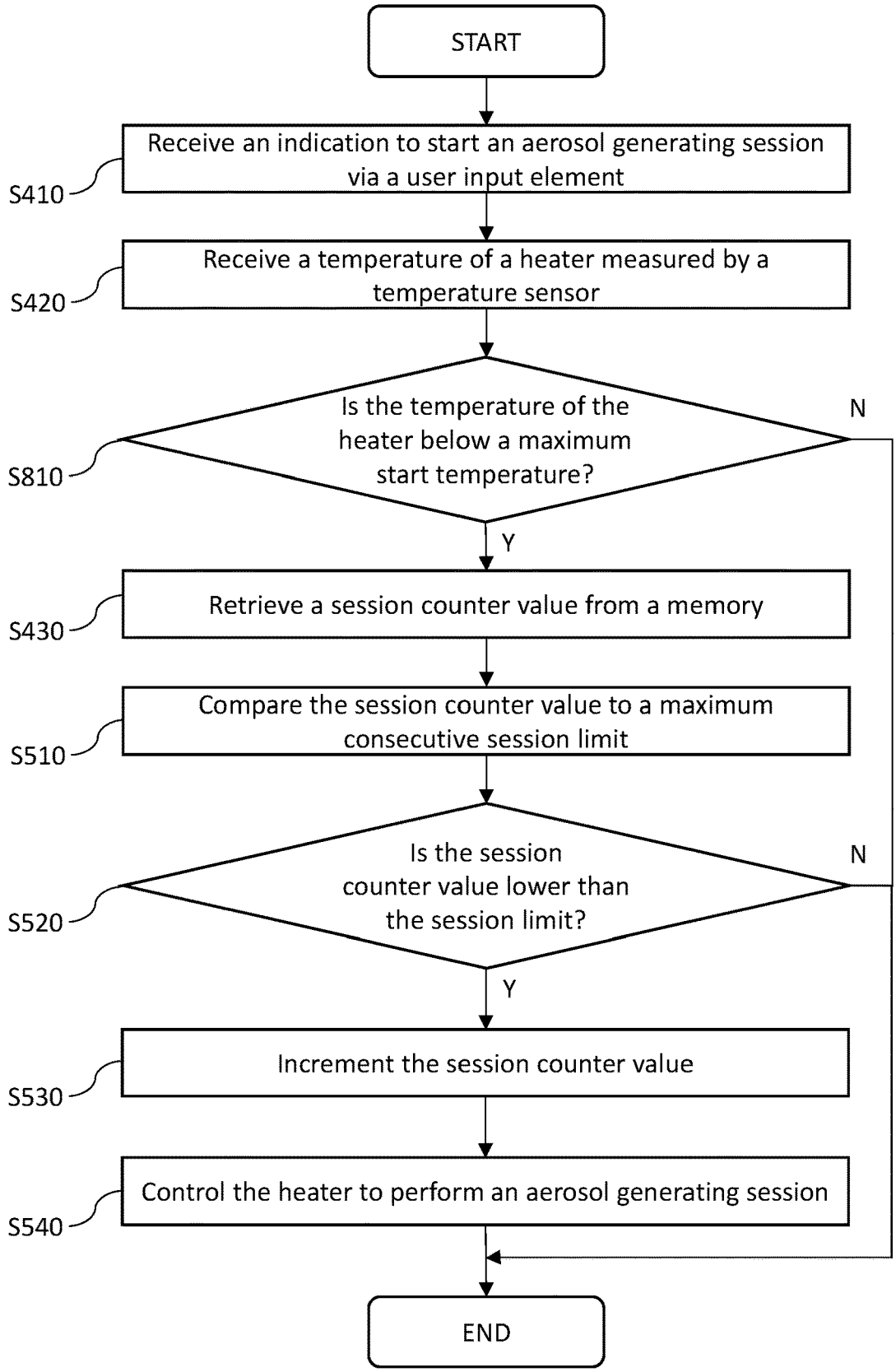
FIG. 8 is a graph schematically illustrating consecutive aerosol generating sessions in the aerosol generating device, where temperature of a heater is shown on the y-axis and time is shown on the x-axis.

FIG. 8 is a flowchart schematically illustrating additional detail of a method for controlling the aerosol generating device.

The method of FIG. 8 is largely similar to FIG. 5, but introduces an additional condition for the aerosol generating session at step S810.

Namely, a maximum start temperature $T_4$ is defined. If the received temperature at step S420 is not below this maximum start temperature, then the user input at step S410 is discarded and an aerosol generating session is not performed.

As an alternative, similar to the alternative implementation of step S520 described above, when the control circuitry 14 decides not to perform an aerosol generating session, the control circuitry 14 may wait for a suitable condition for performing the aerosol generating session after a delay. For example, instead of proceeding from step S810 to the end of the method of FIG. 5, the control circuitry 14 may alternatively wait until the temperature of the heater falls below a continuation temperature threshold, and then perform the aerosol generating session. In the case of step S810, the continuation temperature threshold may be equal to the aerosol generation temperature $T_3$ described for FIG. 3, although the continuation temperature threshold may be separately configured. This alternative has the advantage that the device 1 can automatically perform the aerosol generating session as soon as it is ready, but the disadvantage that the user may not expect this. Preferably, if the device 1 is going to provide a delayed aerosol generating session, this is indicated as part of a status indication, as described above.

Additionally or alternatively to the maximum start temperature $T_4$ of the heater, a maximum start temperature of the control circuitry 14 may be compared to a temperature measurement received from the temperature sensor 144 and, if the control circuitry 14 exceeds its maximum start temperature, no aerosol generating session is performed. This has the advantage of preventing the control circuitry 14 from continuing to cause itself to be heated if it is at risk of overheating and becoming unreliable or unpredictable. In a specific example, the maximum start temperature of the control circuitry 14 is preferably 65° C.

Figure 9:
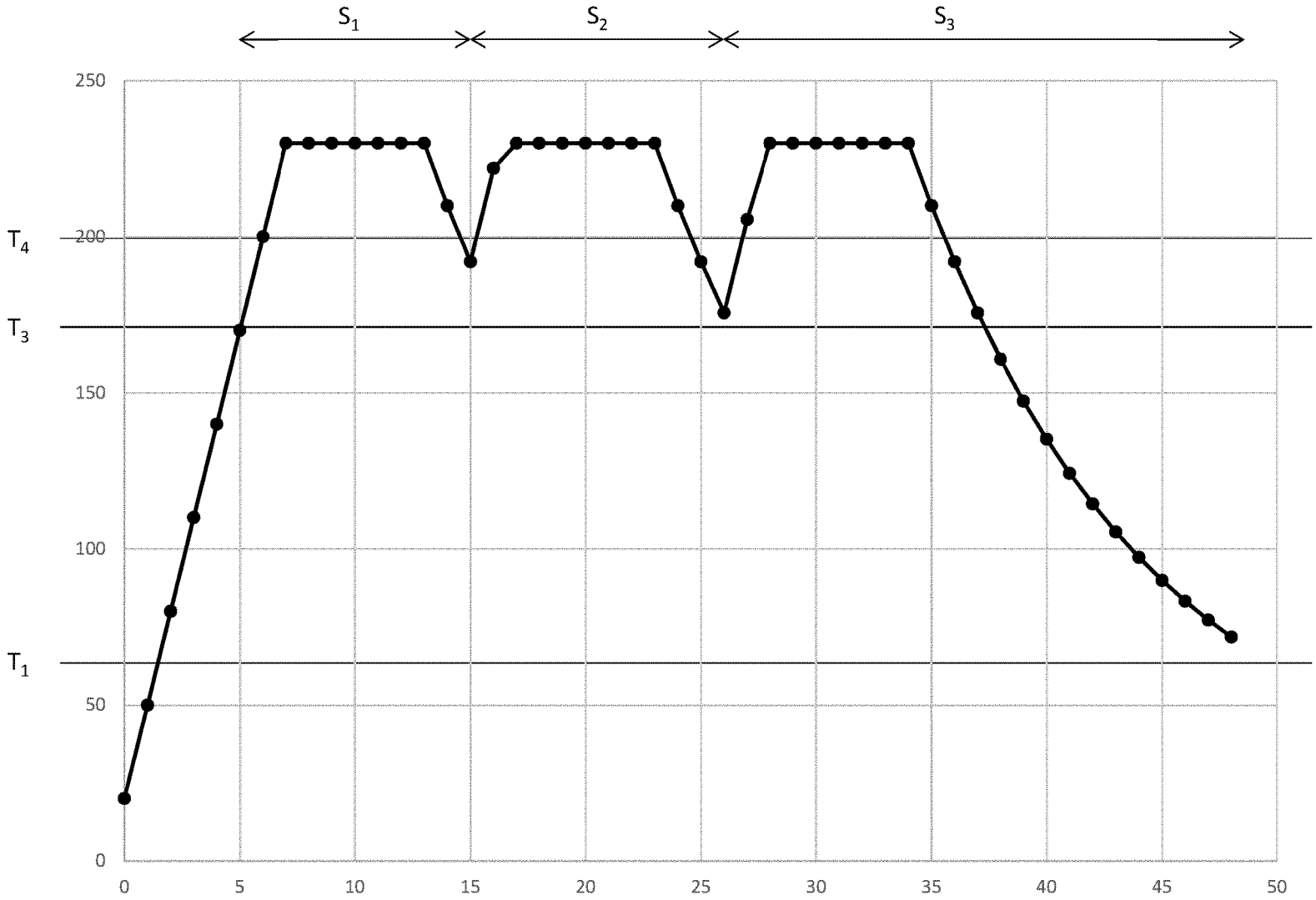
FIG. 9 is a flowchart schematically illustrating additional detail of a method for controlling the aerosol generating device.

FIG. 9 is a graph schematically illustrating consecutive aerosol generating sessions in the aerosol generating device, where temperature of a heater is shown on the y-axis and time is shown on the x-axis.

FIG. 9 can be used to understand the maximum start temperature $T_4$ described above for FIG. 8.

More specifically, after each of sessions $S_1$ and $S_2$, regardless of the session counter value, the next session cannot be started until the temperature of the heater has fallen below the maximum start temperature $T_4$. For ease of explanation, the maximum start temperature $T_4$ is shown as being higher than the aerosol generating temperature $T_3$. However, the maximum start temperature $T_4$ is preferably equal to the aerosol generating temperature $T_3$.

In the above-described embodiments, an aerosol generating device 1 is provided having a control circuitry 14 configured to perform a method for safely operating a heater. The control circuitry 14 may also be provided as a self-contained component that is for the aerosol generating device 1 but separate from the rest of the aerosol generating device. Furthermore, an aerosol generating device 1 may be similar to the device described above but be externally controlled according to the above described methods, without including the control circuitry 14 as a component of the device.

The heating element 12 may be any device for outputting thermal energy sufficient to form an aerosol from the aerosol substrate. The transfer of heat energy from the heating element 12 to the aerosol substrate may be conductive, convective, radiative or any combination of these means. As non-limiting examples, conductive heaters may directly contact and press the aerosol substrate, or they may contact a separate component such as the heating chamber which itself causes heating of the aerosol substrate by conduction, convection, and/or radiation.

Heating elements may be electrically powered, powered by combustion, or by any other suitable means. Electrically powered heating elements may include resistive track elements (optionally including insulating packaging), induction heating systems (e.g. including an electromagnet and high frequency oscillator), etc. The heating element 12 may be arranged around the outside of the aerosol substrate, it may penetrate part way or fully into the aerosol substrate, or any combination of these. For example, instead of the heater of the above-described embodiment, an aerosol generation device may have a blade-type heater that extends into an aerosol substrate in the heating chamber 11.

The term "temperature sensor" is used to describe an element which is capable of determining an absolute or relative temperature of a part of the aerosol generation device 1. This can include thermocouples, thermopiles, thermistors and the like. A temperature sensor 13 may be provided as part of another component, or it may be a separate component. In some examples, more than one temperature sensor may be provided, for example to monitor heating of different parts of the aerosol generation device 1, e.g. to determine thermal profiles. Additionally, in some examples, the temperature sensor may be combined with another feature. For example, a thermistor property of a resistive heating element may be used to measure temperature.

Aerosol generating substrate includes tobacco, for example in dried or cured form, in some cases with additional ingredients for flavouring or producing a smoother or otherwise more pleasurable experience. In some examples, the substrate such as tobacco may be treated with a vaporising agent. The vaporising agent may improve the generation of vapour from the substrate. The vaporising agent may include, for example, a polyol such as glycerol, or a glycol such as propylene glycol. In some cases, the substrate may contain no tobacco, or even no nicotine, but instead may contain naturally or artificially derived ingredients for flavouring, volatilisation, improving smoothness, and/or providing other pleasurable effects. The substrate may be provided as a solid or paste type material in shredded, pelletised, powdered, granulated, strip or sheet form, optionally a combination of these. Additionally, the aerosol substrate may comprise a liquid or gel.

The aerosol generation device 1 could in some embodiments be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The aerosol generation device 1 may be arranged to receive the aerosol substrate in a pre-packaged substrate carrier. The substrate carrier may broadly resemble a cigarette, having a tubular region with an aerosol substrate arranged in a suitable manner. Filters, vapour collection regions, cooling regions, and other structure may also be included in some designs. An outer layer of paper or other flexible planar material such as foil may also be provided, for example to hold the aerosol substrate in place, to further the resemblance of a cigarette, etc. The substrate carrier may fit within the heating chamber 11 or may be longer than the heating chamber 11 such that the lid 17 remains open while the aerosol generation device 1 is provided with the substrate carrier. In such embodiments, the aerosol may be provided directly from the substrate carrier which acts as a mouthpiece for the aerosol generation device.

As used herein, the term "fluid" shall be construed as generically describing non-solid materials of the type that are capable of flowing, including, but not limited to, liquids, pastes, gels, powders and the like. "Fluidized materials" shall be construed accordingly as materials which are inherently, or have been modified to behave as, fluids. Fluidization may include, but is not limited to, powdering, dissolving in a solvent, gelling, thickening, thinning and the like.

As used herein, the term "volatile" means a substance capable of readily changing from the solid or liquid state to the gaseous state. As a non-limiting example, a volatile substance may be one which has a boiling or sublimation temperature close to room temperature at ambient pressure. Accordingly "volatilize" or "volatilise" shall be construed as meaning to render (a material) volatile and/or to cause to evaporate or disperse in vapour.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Consistently with this definition the term "vaporise" (or "vaporize") means: (i) to change, or cause the change into vapour; and (ii) where the particles change physical state (i.e. from liquid or solid into the gaseous state).

As used herein, the term "atomise" (or "atomize") shall mean: (i) to turn (a substance, especially a liquid) into very small particles or droplets; and (ii) where the particles remain in the same physical state (liquid or solid) as they were prior to atomization.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. A method for controlling an aerosol generating device, the method comprising:

receiving an indication to start an aerosol generating session via a user input element;

receiving a temperature of a heater measured by a temperature sensor;

retrieving a session counter value from a memory;

controlling the heater to perform an aerosol generating session according to the temperature of the heater and the session counter value; and when the temperature of the heater becomes lower than a first predetermined temperature, resetting the session counter value.

2. The method according to claim 1, wherein the session counter value is incremented upon starting the aerosol generating session.

3. The method according to claim 1, further comprising, when the temperature of the heater becomes lower than a second predetermined temperature, higher than the first predetermined temperature, and the session counter value is lower than a first predetermined session limit, resetting the session counter value.

4. The method according to claim 1, wherein the aerosol generating session comprises:

a temperature raising stage in which the temperature of the heater is raised to at least a third predetermined temperature;

a temperature maintaining stage in which the temperature of the heater is maintained; and a temperature falling stage in which the temperature of the heater is allowed to fall below the third predetermined temperature.

5. The method according to claim 1, further comprising:

when the session counter value is not lower than a second predetermined session limit, controlling the heater not to perform an aerosol generating session.

6. The method according to claim 1, further comprising:

when the temperature of the heater is greater than a fourth predetermined temperature when the indication to start an aerosol generating session is received, controlling the heater not to perform an aerosol generating session regardless of the session counter value.

7. The method according to claim 1, wherein when the temperature of the heater is lower than a fifth predetermined temperature when the indication to start an aerosol generating session is received, the session counter value is not incremented.

8. The method according to claim 1, wherein the method further comprises:

controlling the heater not to perform an aerosol generating session after receiving a second indication to start an aerosol generating session, and controlling a user output element to indicate a status wherein the second indication was received but the aerosol generating session is not being performed.

9. The method according to claim 1, wherein the method comprises:

controlling the heater not to perform an aerosol generating session after receiving a second indication to start an aerosol generating session, and waiting until the temperature of the heater falls below a sixth predetermined temperature, and then performing an aerosol generating session.

10. Control circuitry configured to perform the method according to claim 1.

11. The method according to claim 1, wherein the method further comprises:

when a temperature of control circuitry configured to perform the method is greater than a seventh predetermined temperature when the indication to start an aerosol generating session is received, controlling the heater not to perform an aerosol generating session regardless of the session counter value.

12. An aerosol generating device comprising:

the control circuitry according to claim 10, the heater for heating an aerosol generating substrate of a consumable to generate an aerosol, the temperature sensor for measuring a temperature of the heater, the user input element for starting an aerosol generating session, and the memory for storing a session counter value.

13. The method according to claim 1, wherein the aerosol generating session is a period in which a consumable is fully used.

14. The method according to claim 1, wherein the aerosol generating session is a period in which a predetermined amount of aerosol is generated by the aerosol generating device.

* * * * *